US009966213B2

(12) United States Patent
Tsutsui et al.

(10) Patent No.: US 9,966,213 B2
(45) Date of Patent: May 8, 2018

(54) ELECTRONIC DEVICE AND MANUFACTURING METHOD THEREFOR

(71) Applicant: OMRON Corporation, Kyoto (JP)

(72) Inventors: Kazuhiro Tsutsui, Kumamoto (JP); Ayaka Miyake, Kikuchi (JP); Jun Sasaki, Yamaga (JP); Franco Vernaroli, Patrica (IT); Fabio Mangiapelo, Alatri (IT); Francesco Greco, Frosinone (IT)

(73) Assignee: OMRON Corporation, Kyoto (JP)

( * ) Notice: Subject to any disclaimer, the term of this patent is extended or adjusted under 35 U.S.C. 154(b) by 0 days. days.

(21) Appl. No.: 15/123,649

(22) PCT Filed: Nov. 17, 2014

(86) PCT No.: PCT/JP2014/080383

§ 371 (c)(1),
(2) Date: Sep. 5, 2016

(87) PCT Pub. No.: WO2015/136779

PCT Pub. Date: Sep. 17, 2015

(65) Prior Publication Data

US 2017/0076894 A1 Mar. 16, 2017

(30) Foreign Application Priority Data

Mar. 14, 2014 (JP) ..... 2014-052384

(51) Int. Cl.
*H01H 13/04* (2006.01)
*H01H 50/04* (2006.01)
(Continued)

(52) U.S. Cl.
CPC ..... *H01H 50/041* (2013.01); *H01H 49/00* (2013.01); *H01H 50/54* (2013.01);
(Continued)

(58) Field of Classification Search
CPC ..... H01H 50/041; H01H 50/54; H01H 50/64; H01H 49/00; H01R 13/514
(Continued)

(56) References Cited

U.S. PATENT DOCUMENTS 5,286,210 A * 2/1994 Kilsdonk ..... H01R 13/514 439/638
5,454,733 A * 10/1995 Watanabe ..... H01R 13/514 439/540.1
(Continued)

FOREIGN PATENT DOCUMENTS

CA 1108773 9/1981
CN 203416544 1/2014
(Continued)

OTHER PUBLICATIONS

"International Search Report (Form PCT/ISA/210)", dated Jan. 13, 2015, with English translation thereof, pp. 1-4.
(Continued)

*Primary Examiner* — Shawki S Ismail
*Assistant Examiner* — Lisa Homza
(74) *Attorney, Agent, or Firm* — JCIPRNET

(57) ABSTRACT

An electronic device capable of reducing costs for equipment is shown. Of a plurality of housings each having an electromagnetic relay body incorporated therein, the adjacent housings are unified with a disconnectable connector provided on facing outer surfaces of the housings.

9 Claims, 8 Drawing Sheets

(51) Int. Cl.

| | |
|---|---|
| ***H01H 49/00*** | (2006.01) |
| ***H01H 50/54*** | (2006.01) |
| ***H01H 50/64*** | (2006.01) |
| ***H01R 13/514*** | (2006.01) |
| *H01H 50/02* | (2006.01) |

(52) U.S. Cl.
CPC ..... *H01H 50/64* (2013.01); *H01R 13/514* (2013.01); *H01H 50/023* (2013.01); *H01H 2050/049* (2013.01)

(58) Field of Classification Search
USPC ..... 335/202
See application file for complete search history.

(56) References Cited

U.S. PATENT DOCUMENTS

| | | | | |
|---|---|---|---|---|
| 5,634,824 | A * | 6/1997 | Yagi | H01R 13/514 439/701 |
| 5,679,028 | A * | 10/1997 | Yagi | H01R 13/518 439/701 |
| 5,775,953 | A * | 7/1998 | Yamanashi | H01R 13/506 439/357 |
| 5,929,730 | A | 7/1999 | Hendel | |
| 6,146,200 | A * | 11/2000 | Ito | H01R 13/447 439/596 |
| 6,191,672 | B1 * | 2/2001 | Lages | H01R 13/434 335/202 |
| 6,196,882 | B1 * | 3/2001 | Sato | H01R 9/2408 174/50 |
| 6,332,788 | B1 * | 12/2001 | Okabe | H01R 13/62933 439/157 |
| 6,621,394 | B2 | 9/2003 | Ono et al. | |
| 6,659,810 | B2 * | 12/2003 | Okabe | H01R 13/6215 439/364 |
| 8,882,530 | B2 * | 11/2014 | Matsumura | H01R 13/62977 439/372 |
| 8,998,653 | B2 * | 4/2015 | Kamiya | H01R 13/62 439/701 |
| 9,011,173 | B2 * | 4/2015 | Osada | H01R 13/514 439/527 |
| 9,257,788 | B1 * | 2/2016 | Jia | H01R 13/518 |
| 9,437,977 | B1 * | 9/2016 | Belack | H01R 13/648 |
| 9,484,657 | B2 * | 11/2016 | Martin | H01R 13/4223 |
| 2006/0152310 | A1 * | 7/2006 | Tsutsui | H01H 50/62 335/128 |
| 2013/0203299 | A1 * | 8/2013 | Wilkner | H01R 13/4361 439/701 |
| 2015/0333441 | A1 * | 11/2015 | Annis | H01R 13/62911 439/133 |

FOREIGN PATENT DOCUMENTS

| | | |
|---|---|---|
| JP | H08-64452 | 3/1996 |
| JP | H09-147719 | 6/1997 |
| JP | H10-74541 | 3/1998 |
| JP | 2000-251564 | 9/2000 |
| JP | 2003-059383 | 2/2003 |
| JP | 2006-228513 | 8/2006 |
| JP | 2010181243 | 8/2010 |

OTHER PUBLICATIONS

"Search Report of Europe Counterpart Application", dated Oct. 11, 2017, p. 1-p. 10, in which the listed references were cited.

* cited by examiner

ELECTRONIC DEVICE AND MANUFACTURING METHOD THEREFOR

CROSS-REFERENCE TO RELATED APPLICATION

This application is a 371 application of the International PCT Application serial no. PCT/JP2014/080383, filed on Nov. 17, 2014, which claims the priority benefit of Japan Application no. 2014-052384, filed on Mar. 14, 2014. The entirety of each of the above-mentioned patent applications is hereby incorporated by reference herein and made a part of this specification.

TECHNICAL FIELD

The present invention relates to electronic devices, particularly, an electromagnetic relay, a switch, and a sensor.

BACKGROUND ART

Examples of a conventional electronic device include an electromagnetic relay apparatus including a plurality of electromagnetic relays each having a couple of movable contacts that swing by the excitation current flow in a coil and a couple of fixed contacts faced to the movable contacts and set in directions of movement of the movable contacts with the movable contacts set between the fixed contacts. In the electromagnetic relays, one of the movable contacts and one of the fixed contacts form a normally-open contact which is closed when excitation current is applied to the coil, and the other movable contact and the other fixed contact form a normally-closed contact which is closed when current is not passed through the coil. The electromagnetic relays are disposed in line on a base so that the plural normally-open/normally-closed contacts of adjacent electromagnetic relays are faced to each other and located in opposed outer positions in substantially point symmetrical relation with the swing center side of the movable contacts being located outward (refer to Patent Literature 1).

The electromagnetic relay is a bipolar electromagnetic relay in which two sets of electromagnet blocks 1, 1 are incorporated in one housing including a base block 2 and a cover B mounted to the base block 2, as shown in FIGS. 1 and 3 of the Patent Literature 1.

CITATION LIST

Patent Literature

1: Japanese Unexamined Patent Publication No. 2003-59383

SUMMARY OF INVENTION

Technical Problem

However, for example, as shown in FIGS. 7A and 7B, when a bipolar electromagnetic relay 32 described above is to be assembled, it is necessary to prepare in a manufacturing process a transfer rail 30 provided with a wide guide groove 31. Meanwhile, as shown in FIGS. 8A and 8B, when a unipolar electromagnetic relay is to be assembled, it is necessary to separately prepare a transfer rail 33 provided with a narrow guide groove 34. Hence the two kinds of transfer rails 30, 33 and, furthermore, two kinds of production lines, need to be prepared, thus causing a problem of high costs for equipment.

In view of the above problem, an object of an electronic device according to the present invention is to provide an electronic device capable of reducing costs for equipment.

Solution to Problem

In order to solve the above problem, an electronic device according to the present invention includes: an internal component; a plurality of housings each having the internal component incorporated therein; and a disconnectable connector that connects facing outer surfaces of the adjacent housings of the plurality of housings to each other to unify the adjacent housings.

Advantageous Effects of Invention

According to the present invention, the electronic device with the internal component incorporated in each of the plurality of unified housings may be used as it is. Alternatively, the connector may be cut as needed and the electronic devices each having the internal component incorporated in one housing may be individually used. Hence, it is possible to reduce the number of production lines, leading to a reduction in costs for equipment.

As an embodiment of the present invention, the electronic component may include a pair of disconnectable connectors that connect the facing outer surfaces of the adjacent housings to each other to unify the adjacent housings, and the pair of disconnectable connectors may be inclined so as to be line-symmetric.

According to the present embodiment, appropriately cutting the pair of connectors enables manufacturing of a plurality of kinds of electronic devices on one production line.

Further, even when the pair of connectors is cut by a cutter, only a part of a blade of the cutter is not used. Therefore, the wear of the blade is not concentrated on the same place, thus extending the life of the cutter and reducing a replacement frequency of the cutter.

The pair of connectors may be inclined in a direction in which, with a symmetric axis of line-symmetry at a center, a distance increases from one end to the other end of each connector, and may also be inclined with a wider inclination angle from a bend portion, provided in a middle of each connector, toward the other end.

According to the present embodiment, appropriately cutting each connector allows manufacturing of a plurality of kinds of electronic devices on one production line.

Further, even when the pair of connectors is cut by a cutter, only a part of a blade of the cutter is not used. Therefore, the wear of the blade is not concentrated on the same place, thus extending the life of the cutter and reducing a replacement frequency of the cutter.

Moreover, since each connector is bent with a wider inclination angle from the bend portion toward the other end, each connector has higher mechanical strength and becomes more resistant to damage.

As another embodiment of the present invention, the internal component may be an electromagnetic relay body that drives a contact opening and closing mechanism by use of an electromagnet unit.

According to the present embodiment, a plurality of kinds of electromagnetic relays can be obtained on one production line.

As still another embodiment of the present invention, the internal component may be a switch body that drives a contact opening and closing mechanism.

According to the present embodiment, a plurality of kinds of switches can be obtained on one production line.

As yet another embodiment of the present invention, the internal component may be a sensor body including a detection element capable of detecting an external environment.

According to the present embodiment, a plurality of kinds of sensors can be obtained on one production line.

A manufacturing method for an electronic device according to the present invention may include: incorporating an internal component in each of a plurality of housings that are unified in such a manner that a disconnectable connector connects faces outer surfaces of the housings to each other; and cutting the connector to separate the housings from each other.

According to the present invention, the connector is cut as needed, and electronic devices each having the internal component incorporated in one housing can be individually used. For this reason, there is an effect of obtaining a manufacturing method for an electronic device, capable of reducing the number of production lines and thereby reducing costs for equipment.

DESCRIPTION OF EMBODIMENTS

Figure 1A:
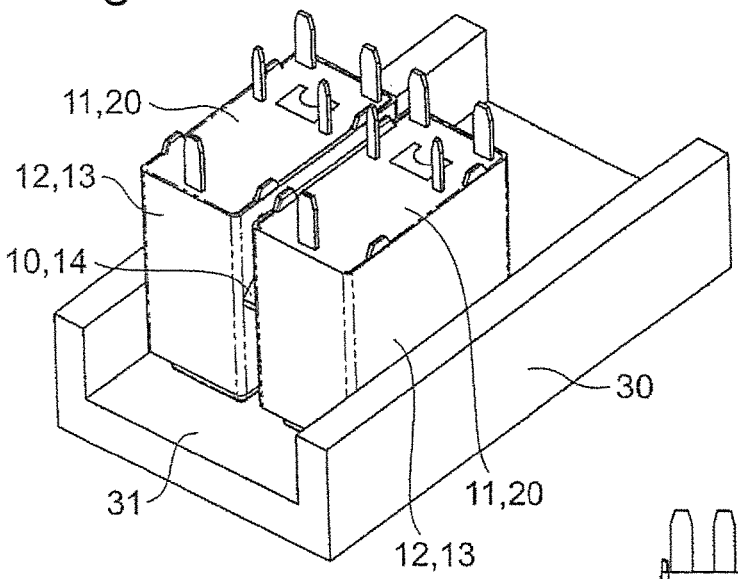
FIG. 1A and FIG. 1B are a perspective view and a front view showing a process of manufacturing an electromagnetic relay that is an electronic device according to the present invention.

Embodiments of an electronic device according to the present invention will be described in accordance with the attached drawings of FIGS. 1A to 6B.

An electronic device 10 according to a first embodiment is a case of applying the electronic device to an electromagnetic relay as shown in FIGS. 1A to 2B.

As shown in FIGS. 1A to 1D, specifically, the electronic device 10 includes: two housings 13 each formed of a base 11 and a case 12 fitted to the base 11; an electromagnetic relay body 20 incorporated in each of the two housings 13; and disconnectable connectors 14, 14 that connect facing outer surfaces of the housings 13, 13 to each other to unify the housings 13, 13.

The electromagnetic relay body 20 is made up of: an electromagnet unit 21 provided upright on the base 11; a movable iron piece 22 that revolves based on excitation and degaussing of the electromagnet unit 21; a movable contact piece 23 that is bent (swaged) and fixed to the movable iron piece 22 and revolves integrally with the movable iron piece 22; and a normally-closed fixed contact 24*a* and a normally-open fixed contact 25*a* which a movable contact 23*a*, provided on a free end of the movable contact piece 23, alternately comes into contact with and is separated from. The normally-closed fixed contact 24*a* and the normally-open fixed contact 25*a* are respectively bent (swaged) and fixed to a normally-closed fixed contact terminal 24 and a normally-open fixed contact terminal 25 each provided upright on the base 11. Further, a terminal part 23*b* of the movable contact piece 23 is pressed and fixed into the base 11, and terminal parts 24*b*, 25*b* of the normally-closed fixed contact terminal 24 and normally-open fixed contact terminal 25 are each pressed and fixed into the base 11.

Figure 1B:
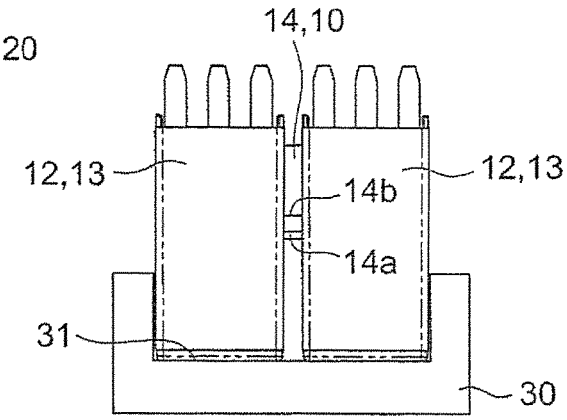
Figure 1C:
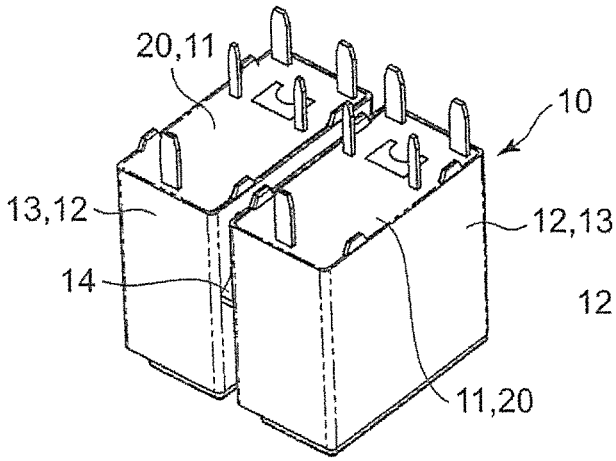
FIG. 1C is a perspective view showing the electromagnetic relay immediately after assembly.
Figure 1D:
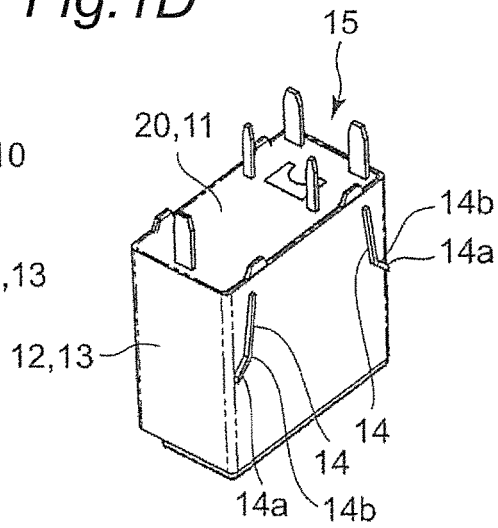
FIG. 1D is a perspective view showing a separated electromagnetic relay.
Figure 2A:
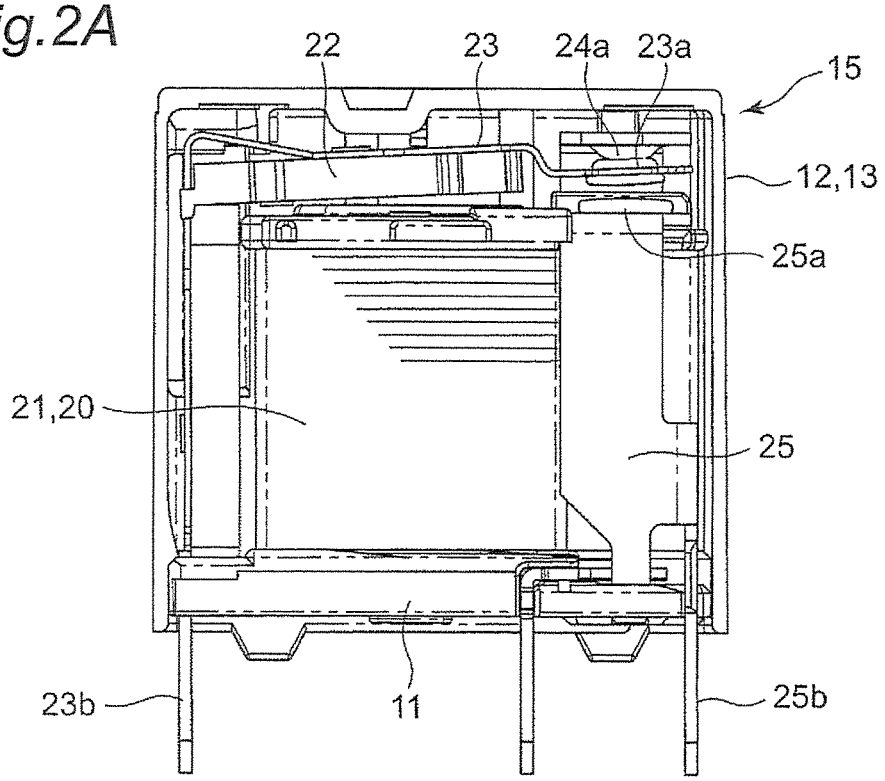
FIG. 2A and FIG. 2B are a front sectional view and a side sectional view of the electromagnetic relay shown in FIG. 1D.
Figure 2B:
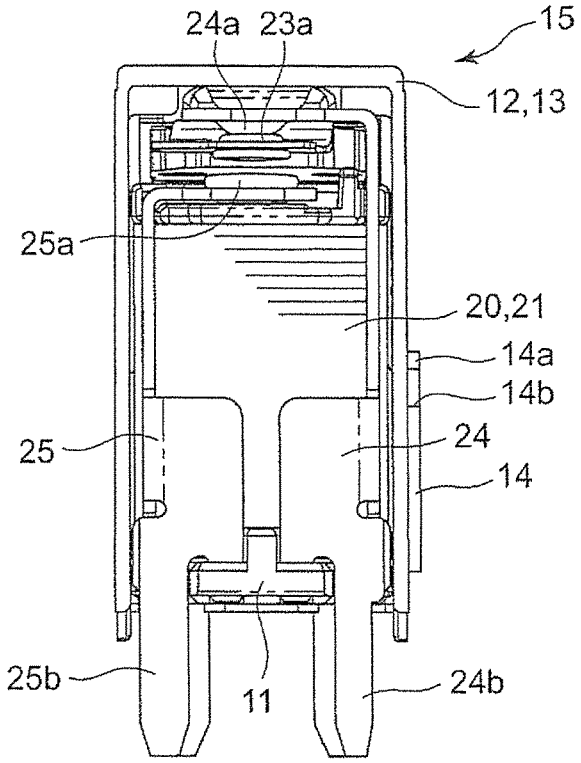

As shown in FIG. 1D, the pair of cases 12, 12 is unified in such a manner that the facing outer surfaces thereof are connected to each other by the pair of disconnectable connectors 14. The connectors 14 are inclined so as to be line-symmetric, and one ends 14*a* thereof are bent outward.

That is, each of the connectors 14 is inclined in a direction in which a distance increases from one end toward the other end with respect to a symmetric axis. Further, the one end 14*a* which is formed from a bend portion 14*b* provided in the middle of each connector 14 toward the other end is inclined with a wider inclination angle.

This is aimed to facilitate manufacturing and molding of a mold and is also aimed to make a blade of a cutter (not shown) uniformly worn out in cutting operation after the molding. In particular, bending of the one end 14*a* of the connector 14 with a wider inclination angle from the bend portion 14*b* is aimed to enhance the mechanical strength, thereby preventing damage to be caused at the time of chucking with a chucking machine (not shown).

The blade of the cutter is moved along the foregoing symmetric axis in the cutting operation. Each connector 14 at this time may be disposed in a direction in which the distance from the symmetric axis increases, or may conversely be disposed in a direction in which the distance from the symmetric axis decreases.

In the present embodiment, as shown in FIGS. 1A and 1B, after placement of the pair of cases 12, 12 in a guide groove 31 of a wide transfer rail 30, the electromagnetic relay body 20 mounted to the base 11 is incorporated in the case 12. Subsequently, a sealing material is poured into the base 11 and solidified for resin sealing. The operation of assembling the electronic device 10 as a bipolar electromagnetic relay is thus completed.

If a bipolar electromagnetic relay is required, the electronic device 10 may be used as one electromagnetic relay as it is (FIG. 1C). If a unipolar electromagnetic relay is required, the electronic device 10 may be used as a unipolar electromagnetic relay 15, by cutting the pair of connectors 14 with a cutter (FIG. 1D).

Figure 3A:
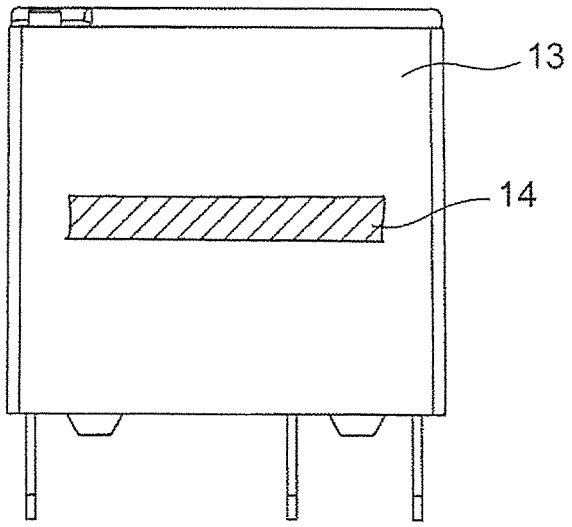
FIG. 3A and FIG. 3B are front views respectively showing a second embodiment and a third embodiment of the electronic device according to the present invention.
Figure 3B:
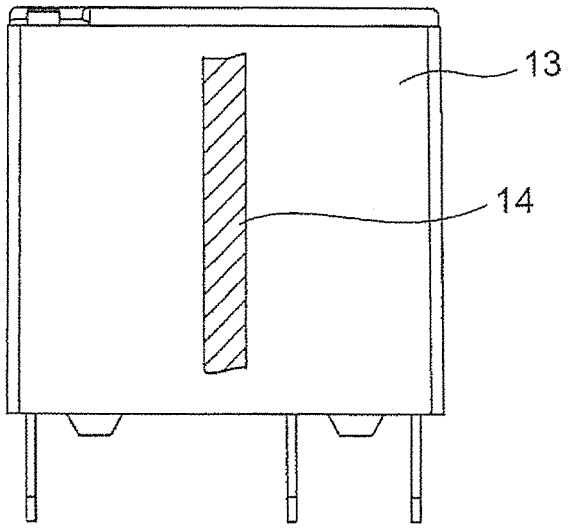

The electronic device according to the present embodiment is not restricted to the foregoing embodiment. For example, as shown in FIGS. 3A and 3B, each of the facing surfaces of the housings 13 may be provided with a laterally-long linear connector 14 (second embodiment) or may be provided with longitudinally-long linear connectors 14, 14 (third embodiment).

Figure 4A:
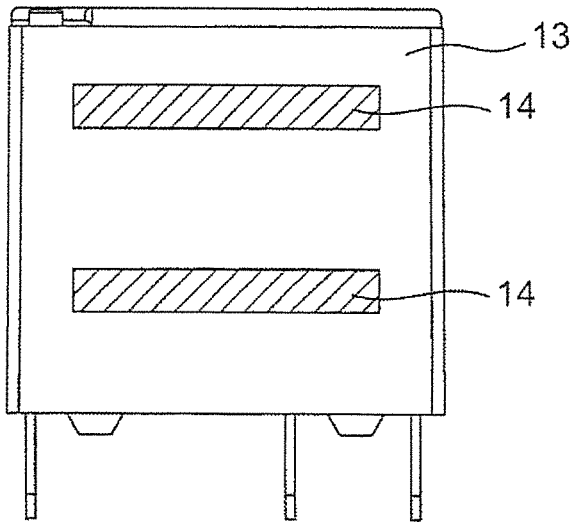
FIG. 4A and FIG. 4B are front views respectively showing a fourth embodiment and a fifth embodiment of the electronic device according to the present invention.
Figure 4B:
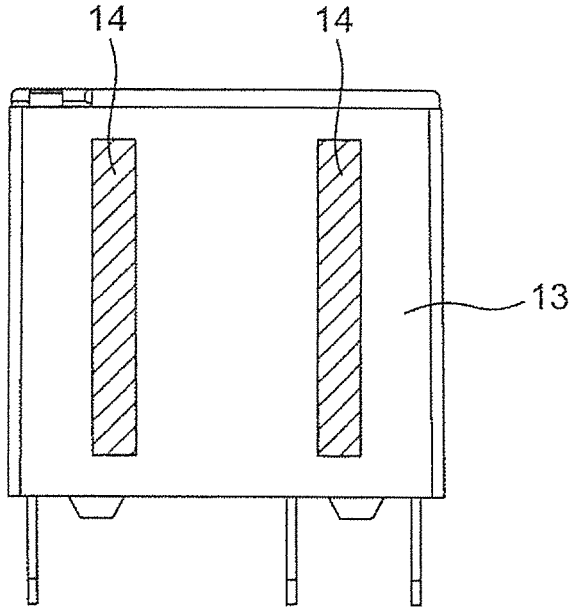

Further, in the electronic device according to the present embodiment, for example, as shown in FIGS. 4A and 4B, each of the facing surfaces of the housings 13 may be provided with two laterally-long linear connectors 14 (fourth embodiment), or may be provided with two longitudinally-long linear connectors 14, 14 (fifth embodiment).

Figure 5A:
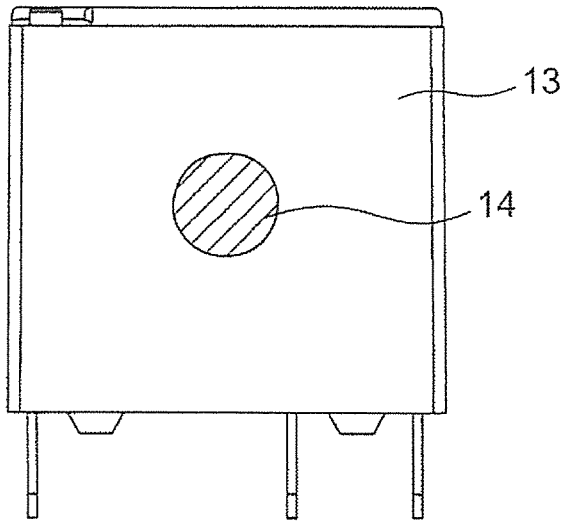
FIG. 5A and FIG. 5B are front views respectively showing a sixth embodiment and a seventh embodiment of the electronic device according to the present invention.
Figure 5B:
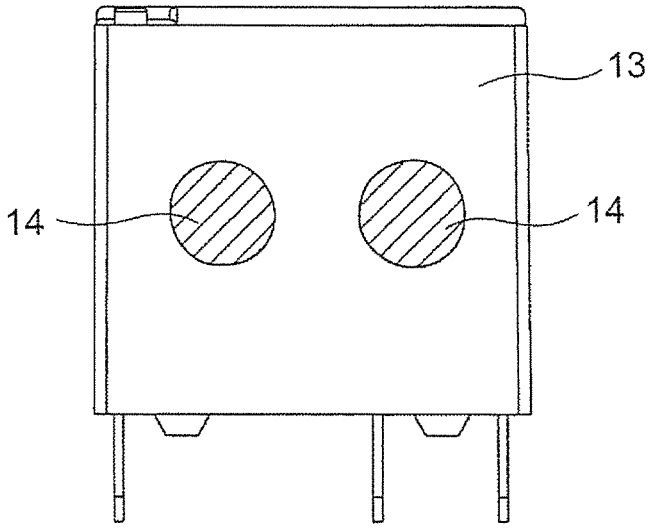

Moreover, in the electronic device according to the present embodiment, for example, as shown in FIGS. 5A and 5B, each of the facing surfaces of the housings 13 may be provided with one connector 14 having a circular cross section (sixth embodiment) or may be provided with a pair of connectors 14, 14 each having the same cross section (seventh embodiment).

Figure 6A:
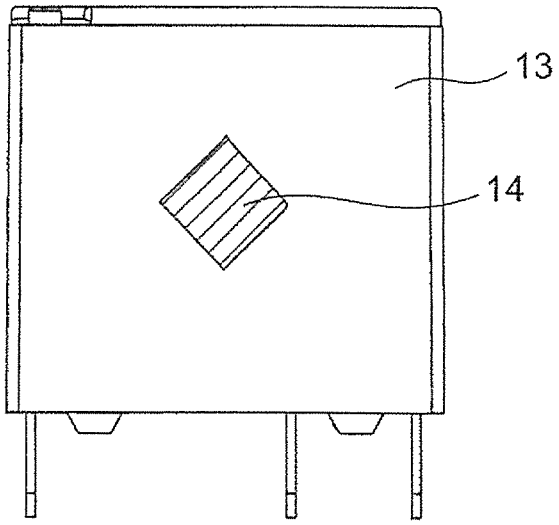
FIG. 6A and FIG. 6B are front views respectively showing an eighth embodiment and a ninth embodiment of the electronic device according to the present invention.
Figure 6B:
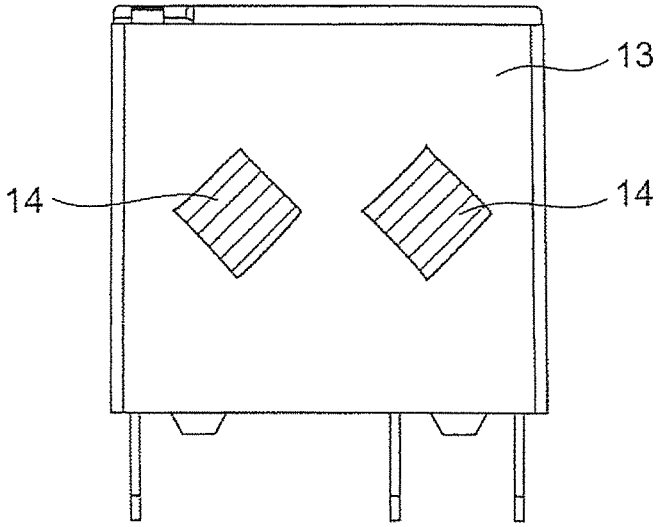
Figure 7A:
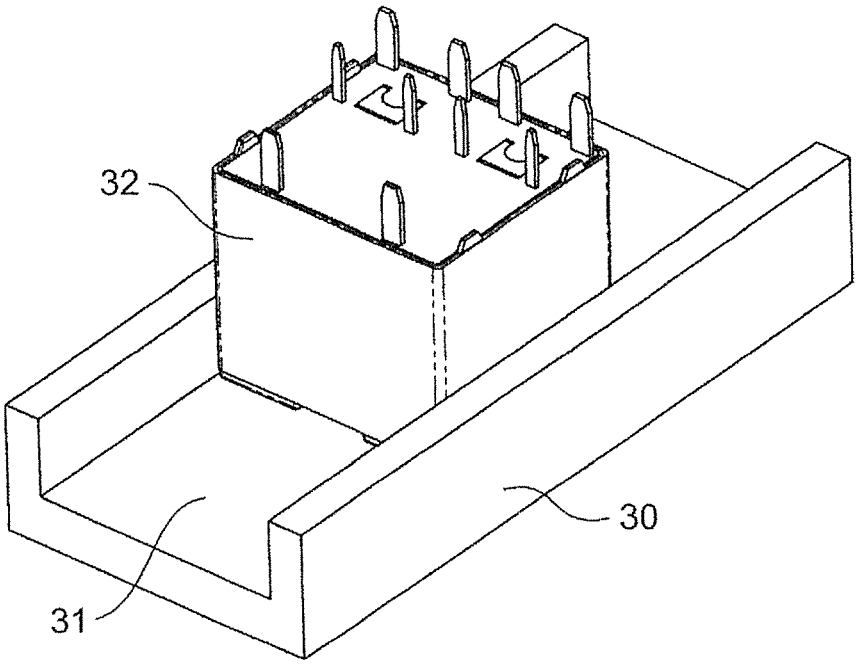
Fig.7A (Related Art)
FIG. 7A and FIG. 7B are a perspective view and a front view showing a process of manufacturing an electronic device according to one conventional example.
Figure 7B:
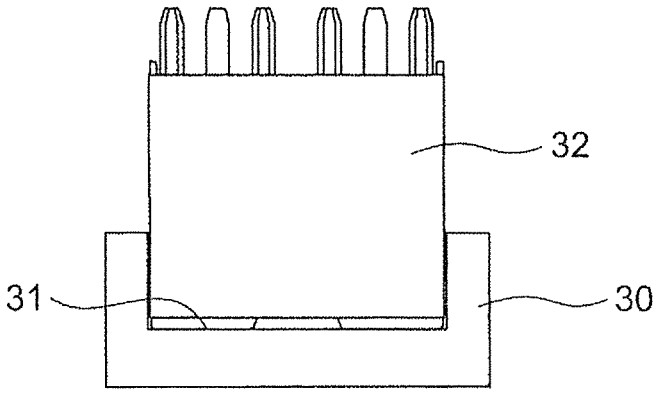
Fig.7B (Related Art)
Figure 8A:
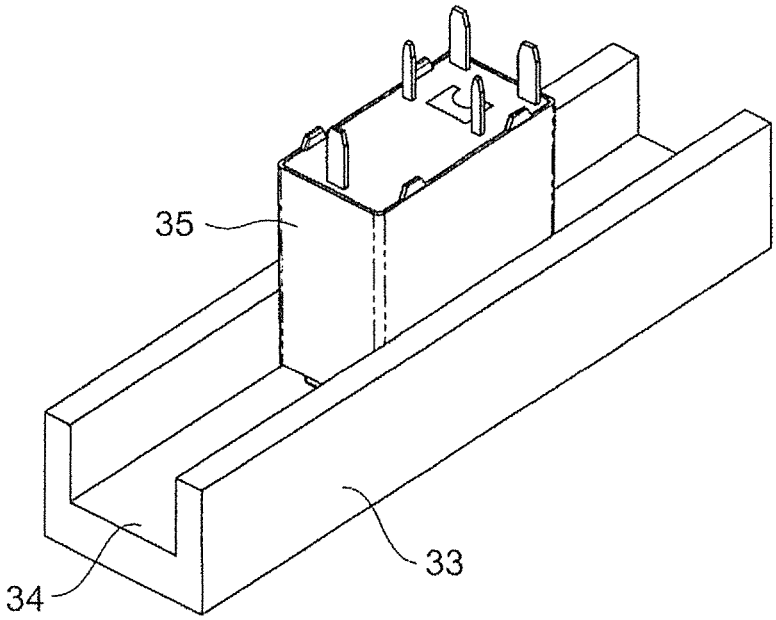
Fig.8A (Related Art)
FIG. 8A and FIG. 8B are a perspective view and a front view showing a process of manufacturing an electronic device according to another conventional example.
Figure 8B:
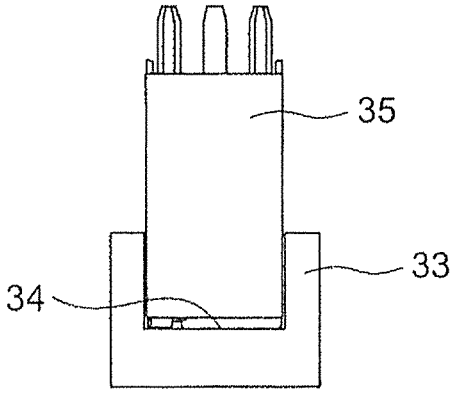
Fig.8B (Related Art)

Alternatively, as shown in FIGS. 6A and 6B, each of the facing surfaces of the housings 13 may be provided with one connector 14 having a quadrilateral cross section (eighth embodiment) or may be provided with a pair of connectors 14, 14 each having the same quadrilateral cross section (ninth embodiment).

As a matter of course, the connectors according to the foregoing embodiments may be appropriately combined as needed. For example, the connector with the quadrilateral cross section and the linear connector may be provided on the outer surface of the same one housing.

Further, two housings with respect to one electronic device is not restrictive, but three or four housings may be applied to one electronic device.

INDUSTRIAL APPLICABILITY

As a matter of course, the electronic device according to the present invention is not restricted to the foregoing electromagnetic relays, but is also applicable to other electronic devices such as a switch and a sensor.

The invention claimed is:

1. An electronic device, comprising:

an internal component;

a plurality of housings each having the internal component incorporated therein;

a first disconnectable connector that connects facing outer surfaces of the adjacent housings of the plurality of housings to each other to unify the adjacent housings; and a second disconnectable connector that connects the facing outer surfaces of the adjacent housings to each other to unify the adjacent housings, wherein the first and second connectors are line-symmetric to each other, and are inclined in a direction in which, with a symmetric axis of line-symmetry at a center, a distance increases from a first end to a second end of each connector.

2. The electronic device according to claim 1, wherein the first and second connectors are also inclined with a wider inclination angle from a bend portion, provided in a middle of each connector, toward the second end.

3. The electronic device according to claim 2, wherein the internal component comprises an electromagnetic relay body that drives a contact opening and closing mechanism by use of an electromagnet unit.

4. The electronic device according to claim 2, wherein the internal component comprises a switch body that drives a contact opening and closing mechanism.

5. The electronic device according to claim 2, wherein the internal component comprises a sensor body including a detection element capable of detecting an external environment.

6. The electronic device according to claim 1, wherein the internal component comprises an electromagnetic relay body that drives a contact opening and closing mechanism by use of an electromagnet unit.

7. The electronic device according to claim 1, wherein the internal component comprises a switch body that drives a contact opening and closing mechanism.

8. The electronic device according to claim 1, wherein the internal component comprises a sensor body including a detection element capable of detecting an external environment.

9. A manufacturing method for an electronic device, comprising:

incorporating an internal component in each of a plurality of housings that are unified in such a manner that a first and a second disconnectable connectors connect facing outer surfaces of the housings to each other, the first and second connectors being line-symmetric to each other, and being inclined in a direction in which, with a symmetric axis of line-symmetry at a center, a distance increases from a first end to a second end of each connector; and cutting the connector to separate the housings from each other.

* * * * *